US007252559B1

(12) United States Patent
Morello et al.

(10) Patent No.: US 7,252,559 B1
(45) Date of Patent: Aug. 7, 2007

(54) TWO PIECE ELECTRICAL TERMINAL

(75) Inventors: John R. Morello, Warren, OH (US); Jon C. Hobbs, Burghill, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/580,547

(22) Filed: Oct. 13, 2006

(51) Int. Cl.
*H01R 13/187* (2006.01)

(52) U.S. Cl. ..... 439/843; 439/852

(58) Field of Classification Search ..... 439/843, 439/845–847, 851, 852, 842
See application file for complete search history.

(56) References Cited

U.S. PATENT DOCUMENTS 4,713,026 A 12/1987 Mobley et al.
5,474,479 A * 12/1995 Bennett et al. ..... 439/843
5,529,518 A 6/1996 Wood
5,533,914 A 7/1996 Sawada
5,800,220 A 9/1998 Feeny et al.
2004/0116002 A1* 6/2004 Rozet et al. ..... 439/843

* cited by examiner

*Primary Examiner*—Hae Moon Hyeon
(74) *Attorney, Agent, or Firm*—David P. Wood

(57) ABSTRACT

An electrical female terminal is provided of two piece construction comprising an outer body and an inner body. The outer body has a forward shield portion and rearward conduction attaching portion. The inner body has a forward receptacle portion and a rearward conduction contacting portion enabling current to flow from a mating terminal to an attached electrical cable via the inner body. The receptacle portion includes resilient contact arms. The shield portion of the outer body surrounds the receptacle portion. The shield portion includes back-up spring members that enable the receptacle portion to maintain a normal force on a mating terminal even if the contact arms relax.

19 Claims, 3 Drawing Sheets

TWO PIECE ELECTRICAL TERMINAL

TECHNICAL FIELD

The present invention relates generally to electrical terminals and more specifically to tab receptacle terminals that are attached to electric cables for use in electrical connectors.

BACKGROUND OF THE INVENTION

Tab receptacle terminals having a one-piece design are described in Mobley, et al., U.S. Pat. No. 4,713,026 and Feeny, et al., U.S. Pat. No. 5,800,220. A problem with the known one-piece designs is that materials that have good electrical properties typically are not suitable for high temperature applications. High temperatures cause contact springs within the terminal to relax over time, thereby reducing retention force between the tab receptacle terminal and a mating member such as a male terminal blade or tab. This causes the current carrying capacity of the mater terminals to decrease or leads to unintended separation of the tab receptacle terminal from the mating member.

It is already known to provide electrical female terminals of two-piece construction comprising a terminal member and an inner spring contact member. In a known female terminal, the terminal member has a shield portion on one end and crimp wings at the other end to attach the terminal member to the end of a cable. The shield portion surrounds an inner spring contact member.

A problem associated with this known two-piece female terminal is that electrical current must pass through both the terminal member and the inner spring contact member. As a result, both members must be electrical conductors. In addition, both members are welded together to provide a good electrical interface. Consequently, the electrical mechanical, and weldability properties must all be considered when selecting materials for the terminal member and the inner spring contact member. This limits the materials available for selection and adds cost. Consequently, materials chosen for each member become compromises that do not ideally satisfy all of the requirements. Furthermore, an additional electrical interface is created within the terminal because the electrical current must flow between the inner spring contact member and the terminal member.

SUMMARY OF THE INVENTION

The present invention provides advantages and alternatives over the prior art with a two-piece female terminal comprising an outer body and an inner body with each piece constructed for the particular application of the piece. Importantly, the terminal is also capable of being used in high temperature environments.

The inner body is made of an electrically conductive material. A receptacle portion of the inner body includes a contact element which provides electrical contact to a mating terminal. The inner body extends from the receptacle portion to a conductor contacting portion enabling current to flow from the mating terminal to an attached electrical conductor via the inner body. Since the same piece provides the electrical contact for the mating terminal as well as the electrical contact to an attached conductor the electrical interfaces of the terminal are minimized.

The outer body includes a forward shield portion and a rearward conductor attaching portion. The inner body includes a forward receptacle portion and a rearward conductor contacting portion. The shield portion of the outer body surrounds the receptacle portion of the inner body. In a preferred embodiment, the outer body includes back-up springs that support the contact element of the inner body. The conductor attaching portion includes features for attaching the terminal to an electrical conductor such as a cable.

The terminal is also modular. Inner bodies made from different conductive materials can be interchanged with a particular outer body design without affecting crimp strength and other crimp properties.

These and other features and advantages of the present invention will become apparent from the following brief description of the drawings, detailed description, and appended drawings.

BRIEF DESCRIPTION OF THE DRAWINGS

The present invention will now be described, by way of example, with reference to the accompanying drawings, in which.

DETAILED DESCRIPTION OF THE INVENTION

Figure 1:
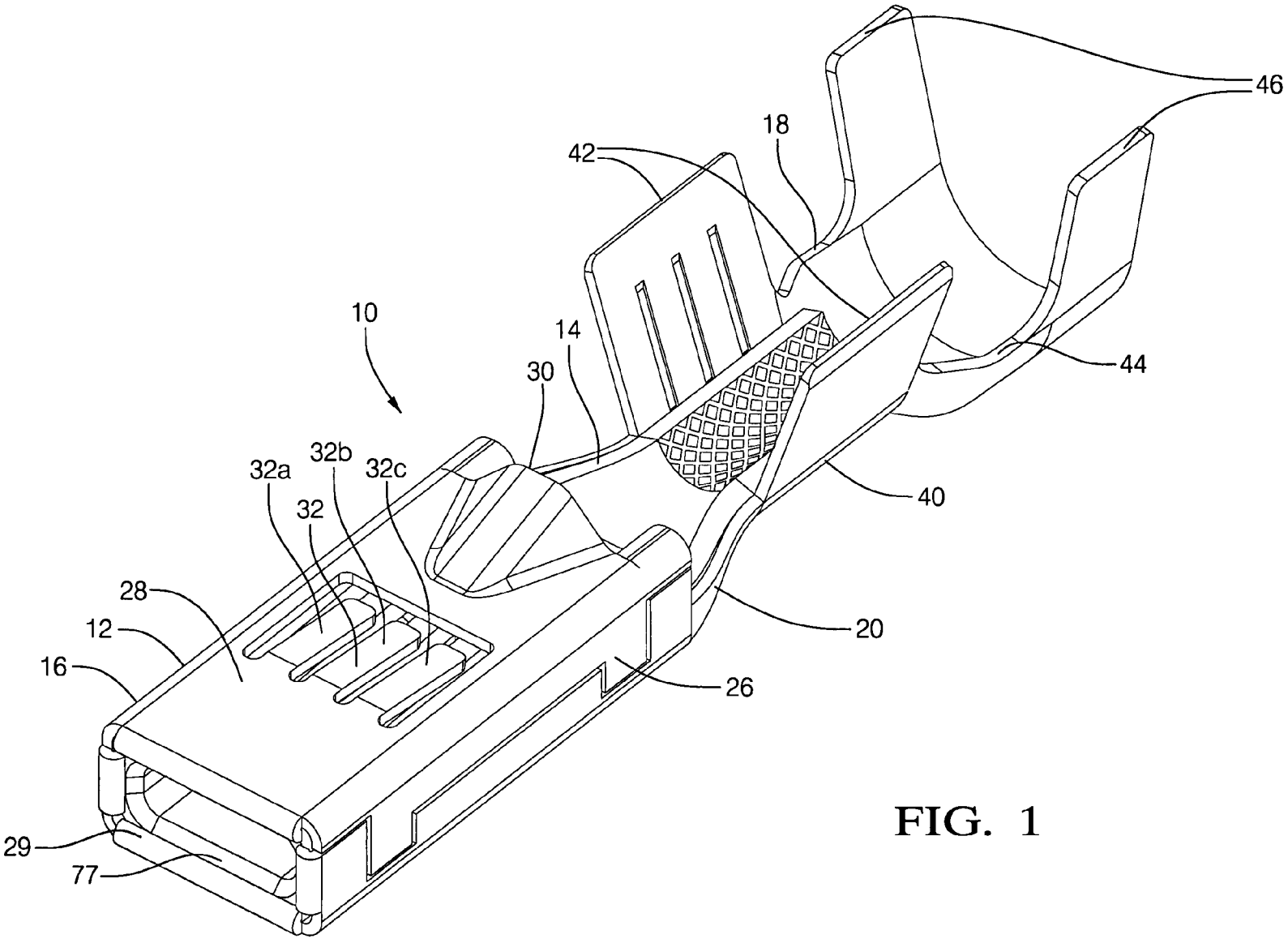
FIG. 1 is perspective view of the terminal of the present invention.
Figure 2:
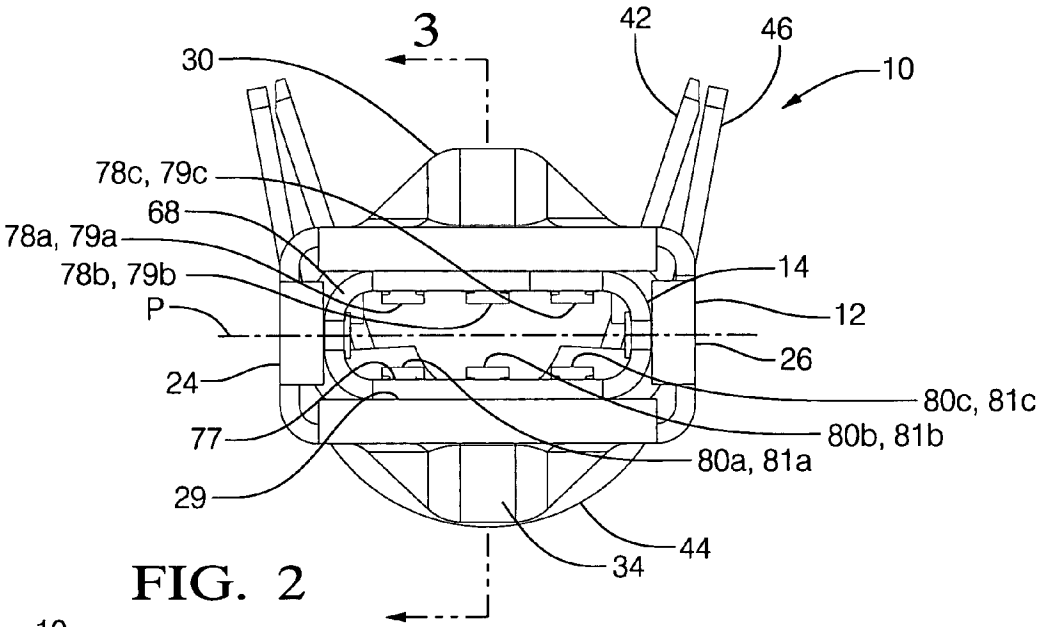
FIG. 2 is an end elevational view of the terminal of the present invention.
Figure 3:
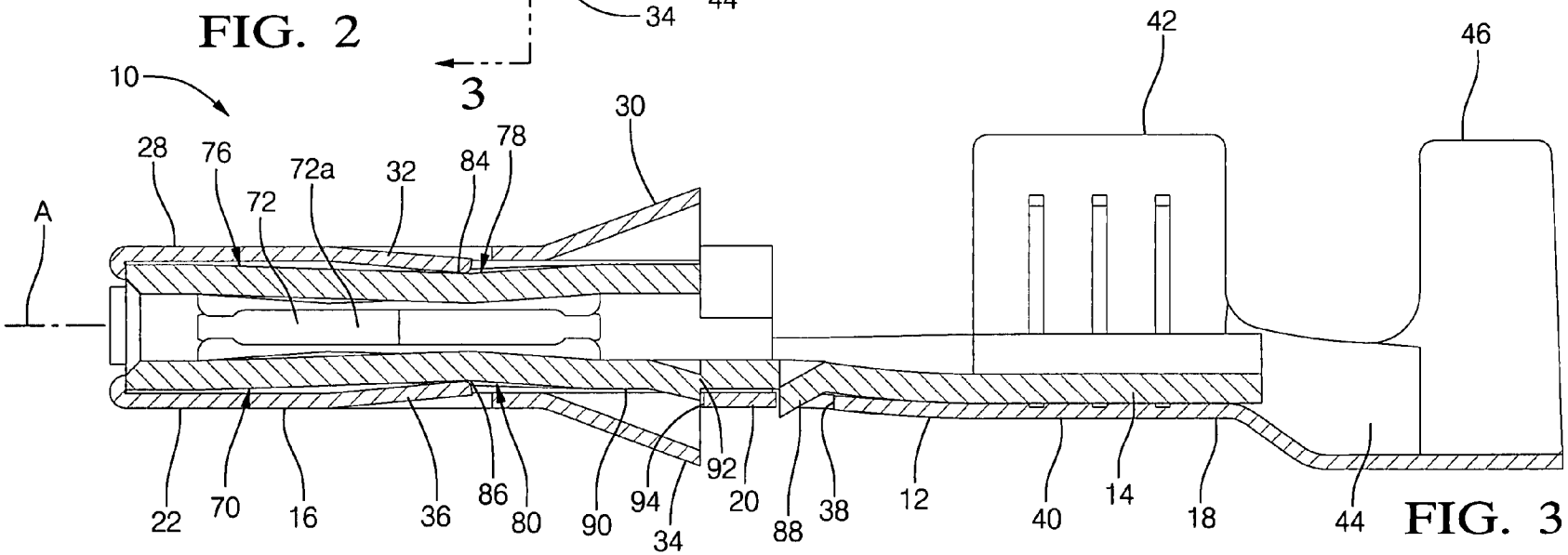
FIG. 3 is a cross-sectional view of the terminal of the present invention taken along line 3-3 of FIG. 2.
Figure 4:
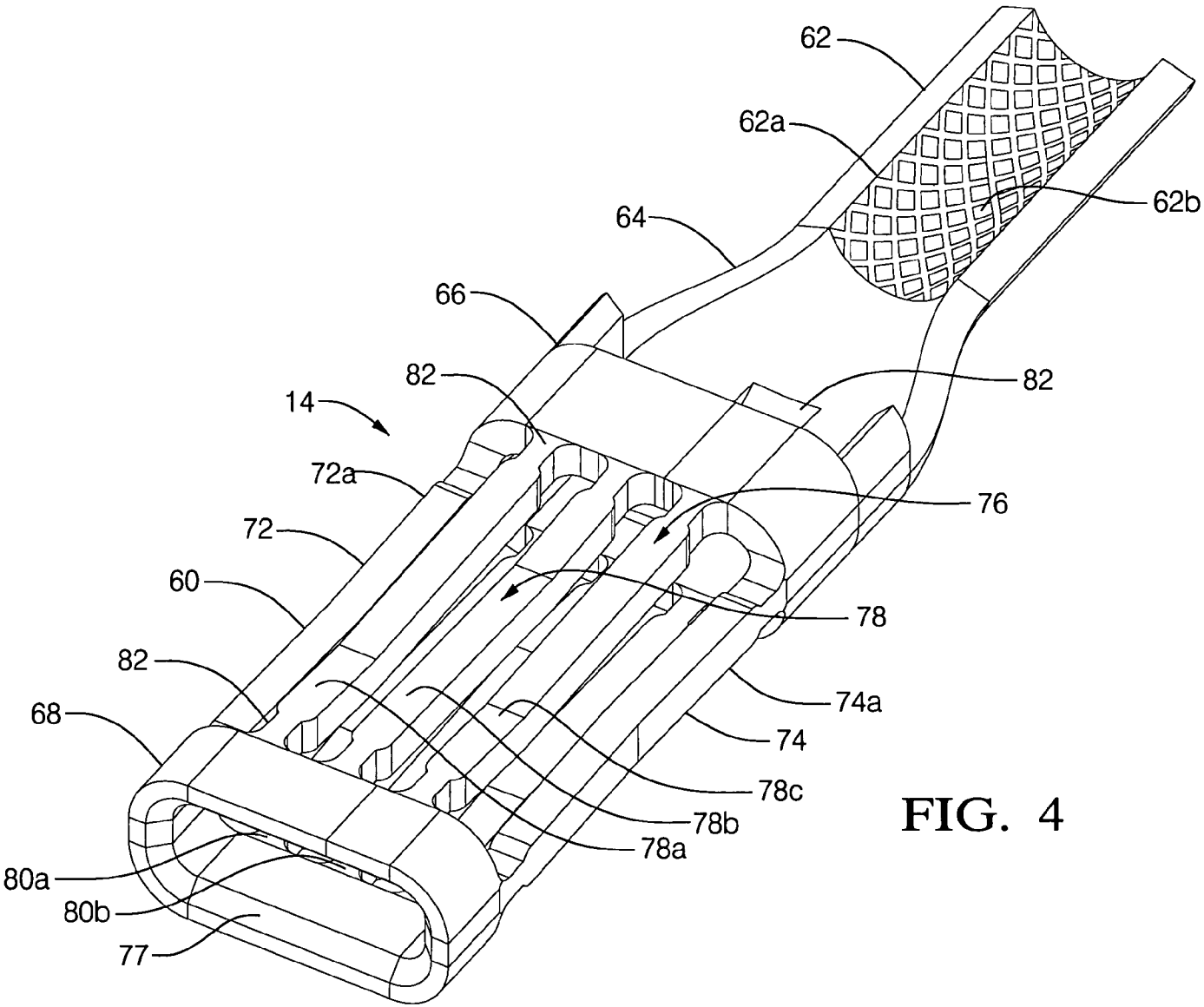
FIG. 4 is a perspective view of one aspect of the terminal of the present invention.

Referring to FIGS. 1 to 4 wherein like numerals refer to like elements throughout the several views, a preferred embodiment of a female terminal 10 of the present invention is illustrated having a two-piece construction that includes an outer body 12 and an inner body 14. The female terminal 10 has a longitudinal axis A as shown in FIG. 3 and a plane P as shown in FIG. 2 extending longitudinally and laterally across the female terminal 10.

The outer body 12 is stamped and formed from a metal sheet. The metal sheet is preferably stainless steel. The inner body 14 is stamped and formed from a sheet of an electrically conductive material such as brass. Other materials known to those skilled in the art may be used. Since current flows from a mating terminal through the inner body 14 to an attached conductor it is not necessary that the outer body 12 be comprised of an electrically conducting material. Alternatively, the outer body 12 can be made from an electrically conductive material.

The outer body 12 includes a forward, generally box shaped, shield portion 16 having a substantially rectangular cross-section, a rearward conductor attaching portion 18 and an intermediate outer body neck 20 located therebetween. The shield portion 16 includes a generally planar bottom wall 22, first and second spaced side walls 24, 26 extending vertically from the bottom wall 22, and a generally planar top wall 28 extending laterally from the first side 24. The bottom wall 22, the first and second spaced side walls 24, 26, and the top wall 28 define an opening 29 for receiving a mating member (not shown). The top wall 28 includes a first primary lock tab 30 and a first back-up spring 32. The first primary lock tab 30 is formed from the top wall 28 and extends outwardly. The first back-up spring 32 is constituted as individual deflectable first spring fingers 32*a*, 32*b*, 32*c* formed from the top wall 28. Each of the first spring fingers 32*a*, 32*b*, 32*c* extend longitudinally rearwardly and are bent inwardly toward plane P. The bottom wall 22 includes a second primary lock tab 34 and a second back-up spring 36. The second primary lock tab 34 is formed from the bottom wall 22 and extends outwardly. The second primary lock tab 34 opposes the first primary lock tab 30 across plane P. The second back-up spring 36 is constituted as individual deflectable second spring fingers (not shown) formed from the bottom wall 22. The second spring fingers (not shown) are similar to the first spring fingers 32*a*, 32*b*, 32*c*. Each of the second spring fingers (not shown) extend longitudinally rearwardly and are bent inwardly toward plane P. The intermediate outer body neck 20 extends rearwardly from the bottom wall 22 transitioning from a planar surface as it extends from the bottom wall 22 to an arcuate surface. The intermediate outer body neck 20 has a first retaining aperture 38. The conductor attaching portion 18 extends rearwardly from the intermediate neck 20. The conductor attaching portion 18 includes a rearward extending bottom channel portion 40, a pair of core crimp wings 42, an enlarged diameter portion 44, and a pair of insulation crimp wings 46.

The inner body 14 comprises a forward receptacle portion 60, a rearward conductor contacting portion 62 and an intermediate inner body neck 64 located therebetween. The intermediate inner body neck 64 and conductor contacting portion 62 extend rearwardly as a tail from the forward receptacle portion 60. The receptacle portion 60 of the inner body 14 is located substantially inside the shield portion 16 of the outer body 12. The intermediate inner body neck 64 extends rearwardly from a second collar 66 of the receptacle portion 60 and is disposed along the intermediate outer body neck 20. The conductor contacting portion 62 of the inner body 14 is disposed along the bottom channel portion 40 of the outer body 12. The conductor contacting portion 62 is in the form of a channel 62*a* extending from the intermediate inner body neck 64 into a U-shaped region formed by the bottom channel portion 40 and core crimp wings 42. The conductor contacting portion 62 has an arcuate shape with respect to axis A. The conductor contacting portion 62 contacts the conductive core of an electrical conductor cable (not shown) when the crimp wings 42, 46 are crimped onto the core and insulation of the cable (not shown). The conductor contacting portion 62 has an inwardly curved, knurled upper surface 62*b*.

The receptacle portion 60 of the inner body 14 is adapted to fit within the shield portion 16 of the outer body 12. The receptacle portion 60 includes the second collar 66, a first collar 68, a lower contact element 70, first and second spaced sides 72, 74, and an upper contact element 76. The second collar 66 and first collar 68 each have a substantially rectangular shape with rounded corners. The first collar 68 defines an opening 77 for receiving a mating member (not shown). The upper contact element 76 of the receptacle portion 60 includes a first primary spring element 78 constituted as a resilient lamella strip with the individual upper contact arms or lamella 78*a*, 78*b*, 78*c* extending longitudinally and being bent inwardly defining respective inward facing contact surfaces 79*a*, 79*b*, 79*c*. The lower contact element 70 of the receptacle portion 60 includes a second primary spring element 80 constituted as a resilient lamella strip with the individual lower contact arms or lamellae 80*a*, 80*b*, 80*c* extending longitudinally and being bent inwardly defining respective inward facing contact surfaces 81*a*, 81*b*, 81*c*. The first and second sides 72, 74 are each constituted as a respective resilient contact arm or lamella 72*a*, 74*a* extending longitudinally and being bent inwardly defining respective inward facing contact surfaces 73*a*, 75*a*. The individual upper contact lamellae 78*a*, 78*b*, 78*c* are substantially opposed to the individual lower contact lamellae 80*a*, 80*b*, 80*c* across the plane P. Each of the lamella strips 72*a*, 74*a*, 78*a*, 78*b*, 78*c*, 80*a*, 80*b*, 80*c* have a substantially rectangular cross-section with a narrowed portion 82 at each end.

The first back-up spring 32 is disposed outside the upper contact element 76 with the respect to plane P. Each of the individual first spring fingers 32*a*, 32*b*, 32*c* is bent inwardly toward a corresponding upper contact lamellae 78*a*, 78*b*, 78*c*. Each of the individual first spring fingers 32*a*, 32*b*, 32*c* abutting and supporting corresponding upper contact lamellae 78*a*, 78*b*, 78*c* at an outward facing first contact surface 84. The first back-up spring 32 is biased to urge the upper contact element 76 of the inner body 14 inwardly. This support helps to enable the upper contact element 76 to maintain a normal face on a mating terminal (not shown). Alternatively, there can be a gap (not shown) between the individual first spring fingers 32*a*, 32*b*, 32*c* and the corresponding upper contact lamellae 78*a*, 78*b*, 78*c*. Under this alternative, if the first primary spring element 78 flattens out or relaxes over time, the gap will be eliminated and the corresponding first back-up spring 32 will abut against and support the first primary spring element 78 at the outward facing first contact surface 84 where each of the individual first spring fingers 32*a*, 32*b*, 32*c* contacts the respective upper contact lamellae 78*a*, 78*b*, 78*c*.

Similarly, the second back-up spring 36 is disposed outside the lower contact element 70 with respect to plane P. Each of the individual second spring fingers 36*a*, 36*b*, 36*c* is bent inwardly toward a corresponding lower contact lamellae 80*a*, 80*b*, 80*c*. Each of the individual second spring fingers 36*a*, 36*b*, 36*c* abutting and supporting the corresponding lower contact lamellae 80*a*, 80*b*, 80*c* at an outward facing second contact surface 86. The second back-up spring 36 is biased to urge the lower contact element 70 of the inner body 14 inwardly. This support helps to enable the lower contact element 70 to maintain a normal face on a mating terminal (not shown). Alternatively, there can be a gap (not shown) between the individual second spring fingers 36*a*, 36*b*, 36*c* and the corresponding lower contact lamellae 80*a*, 80*b*, 80*c*. Under this alternative, if the second primary spring element 80 flattens out or relaxes over time, the gap will be eliminated and the corresponding second back-up spring 36 will abut against and support the second primary spring element 80 at the outward facing second contact surface 86 where each of the individual second spring fingers 36*a*, 36*b*, 362*c* contacts the respective lower contact lamellae 80*a*, 80*b*, 80*c*.

The intermediate inner body neck 64 has a first retaining tab 88. The first retaining tab 88 is formed from the intermediate inner body neck 64 and extends frontwardly and outwardly. The first retaining tab 88 extends into the first retaining aperture 38 affixing the inner body 14 to the outer body 12. A bottom portion 90 of the second collar 66 has a second retaining tab 92. The second retaining tab 92 is formed from the bottom portion 90 of the second collar 66 and extends rearwardly and outwardly. The second retaining tab 92 extends into a second retaining aperture 94 formed near the second primary lock tab 34 further affixing the inner body 14 to the outer body 12. Of course, the inner body 14 could also be affixed to the outer body 12 by having a retaining tab (not shown) on the outer body 12 and an aperture (not shown) for receiving the retaining tab (not shown) on the inner body 14. Other means of affixing the inner body 14 to the outer body 12 may also occur to those skilled in the art such as by utilizing a press fit between the inner body 14 and the outer body 12. In addition, after the female terminal 10 is crimped to the wire (not shown), the crimped wire (not shown) further holds the inner body 14 to the outer body 12.

The above described features enable the shield portion 16 of the outer body 12 to be substantially symmetrical with respect to plane P. Thus, the female terminal 10 can be inserted into a connector (not shown) in two opposing orientations.

The above described features also enable a modular terminal in the sense that inner bodies made from different conductive materials can each be used with a particular outer body design without affecting crimp strength and other crimp properties. In addition, outer bodies made from different materials can each be used with a particular inner body design.

This invention has been described with reference to a preferred embodiment and modifications thereto. Further modifications and alternations may occur to others upon reading and understanding the specification. It is intended to include all such modifications and alterations insofar as they come within the scope of the invention. For example, an indexing feature familiar to those skilled in the art such as an indexing rib can be incorporated in the terminal of the present invention to enable the terminal to be inserted into a connector in only one orientation. Obviously, a tang familiar to those skilled in the art such as a latching tang can also be incorporated in the terminal of the present invention.

Having thus described the invention, what is claimed is:

1. An electrical terminal comprising:

an inner body that is made of an electrically conductive material and that has, at its forward portion, a first collar, a second collar at a midportion, a plurality of spaced resilient contact arms extending between said first collar and said second collar, and a tail extending rearwardly from said second collar, said first collar defining an opening for receiving a mating member, each of said plurality of contact arms being bent inwardly for contacting the mating member, said tail having an arcuate rearward end portion; and an outer body having a forward portion generally substantially surrounding said plurality of contact arms, said outer body further having a channel extending rearwardly from said forward portion, a pair of core crimp wings and a pair of insulation crimp wings extending from said channel, said tail being disposed along said channel extending into an area between each of said pair of core crimp wings;

wherein said forward portion of the outer body includes a plurality of inwardly extending deflectable spring fingers, each contacting an outer surface of at least one of the contact arms.

2. An electrical terminal comprising:

an inner body that is made of an electrically conductive material and that has, at its forward portion, a first collar, a second collar at a midpoint, a plurality of spaced resilient contact arms extending between said first collar and said second collar, and a tail extending rearwardly from said second collar, said first collar defining an opening for receiving a mating member, each of said plurality of contact arms being bent inwardly for contacting the mating member, said tail having an arcuate rearward end portion; and an outer body having a forward portion generally substantially surrounding said plurality of contact arms, said outer body further having a channel extending rearwardly from said forward portion, a pair of core crimp wings and a pair of insulation crimp wings extending from said channel, said tail being disposed along said channel extending into an area between each of said pair of core crimp wings;

wherein said forward portion of the outer body includes a first wall and an opposing second wall, each including at least one deflectable spring finger disposed along said plurality of contact arms, each said spring finger being bent generally toward the closest one of said plurality of contact arms.

3. The electrical terminal of claim 2, wherein each said spring finger abuts one of said plurality of contact arms.

4. The electrical terminal of claim 2, wherein at least one of said walls includes an outward extending lock tab.

5. The electrical terminal of claim 2, wherein said outer body has an aperture therein, said inner body further including an outward extending tab, said tab extending into said aperture.

6. The electrical terminal of claim 2, wherein each said first wall and said second wall includes an outward extending lock tab, said lock tab on said first wall opposing said lock tab on said second wall.

7. The electrical terminal of claim 2, wherein said outer body is comprised of an electrically non-conductive material.

8. The electrical terminal of claim 2, wherein said outer body is comprised of an electrically conductive material.

9. An electrical terminal comprising:

an outer body having a shield portion at its forward end portion and a cable attachment at a position on said outer body that is rearward of said shield portion, said shield portion having an opening at a forward end for receiving a mating member; and an inner body made of an electrically conductive material, said inner body having a receptacle portion at its forward end portion and a conductor contacting portion at its rearward end portion, said receptacle portion being generally substantially contained within said shield portion, said receptacle portion having an opening at its forward end for receiving said mating member, said receptacle portion including a resilient element for making electrical contact with said mating member, said conductor contacting portion having a surface for contacting an electrical conductor, said cable attachment receiving said conductor contacting portion so that said conductor portion engages a cable at its conductive core when said electrical terminal is attached to the cable;

wherein the shield portion includes an inwardly extending deflectable spring element that is biased to urge the resilient element inwardly for contacting the mating member.

10. The electrical terminal of claim 9, wherein said cable attachment includes a rearward extending channel, a pair of core crimp wings and a pair of insulation crimp wings extending from said channel.

11. The electrical terminal of claim 10, wherein said shield portion includes a first wall and an opposing second wall.

12. An electrical terminal comprising:

an outer body having a shield portion at its forward end portion and a cable attachment at a position on said outer body that is rearward of said shield portion, said shield portion having an opening at a forward end for receiving a mating member; and an inner body made of an electrically conductive material, said inner body having a receptacle portion at its forward end portion and a conductor contacting portion at its rearward end portion, said receptacle portion being generally substantially contained within said shield portion, said receptacle portion having an opening at its forward end for receiving said mating member, said receptacle portion including a resilient element for making electrical contact with said mating member, said conductor contacting portion having a surface for contacting an electrical conductor, said cable attachment receiving said conductor contacting portion so that said conductor contacting portion engages a cable at its conductive core when said electrical terminal is attached to the cable;

wherein said cable attachment includes a rearward extending channel, a pair of core crimp wings and a pair of insulation crimp wings extending from said channel;

wherein said shield portion includes a first wall and an opposing second wall; and wherein said shield portion further includes a spring element extending from each of said first wall and said second wall, said spring element being biased to urge said resilient element inwardly for contacting the mating member.

13. The electrical terminal of claim 12, wherein said receptacle portion includes a first collar at a forward end of said receptacle portion and a second collar rearward of said first collar, wherein said resilient element extends between said first and second collars.

14. The electrical terminal of claim 13, wherein said resilient element comprises a plurality of contact arms.

15. A two-piece female electrical terminal comprising:

an inner body that is made of an electrically conductive material, said inner body having a receptacle portion at its forward end portion, an integral inner body neck portion at a midportion, and a conductor contacting portion at a rearward end portion, said receptacle portion having a first collar at its forward end, a second collar at its rearward end, and a plurality of spaced resilient contact arms extending between said first collar and said second collar, said first collar defining an opening for receiving a mating member, each of said plurality of contact arms being bent inwardly for contacting the mating member, each of said plurality of contact arms having a narrowed portion at each end, a first retaining tab protruding from said inner body neck portion, said conductor contacting portion including a rearward extending channel; and an outer body having a shield portion at its forward end portion, an integral outer body neck portion at a midportion, and a conductor attaching portion at a rearward end portion, said shield portion including a bottom wall, first and second side walls, and a top wall; said shield portion substantially surrounding said receptacle portion of said inner body, said top wall including a first spring element, said bottom wall including a second spring element, each of said first and second spring elements including a plurality of inwardly extending deflectable spring fingers, each said spring finger contacting an outer surface of one of said plurality of contact arms, said top wall of said outer body including an outward extending first lock tab, said bottom wall of said outer body including an outward extending second lock tab, said outer body neck portion having a first aperture receiving said first retaining tab, said conductor attaching portion including a rearward extending channel, core crimp wings and insulation crimp wings extending from said channel, said conductor contacting portion being disposed along said conductor attaching portion.

16. The two-piece female-electrical terminal of claim 15, wherein said outer body is made of an electrically conductive material.

17. The two-piece female-electrical terminal of claim 16, wherein said outer body is made of an electrically non-conductive material.

18. The two-piece female electrical terminal of claim 15, wherein a second retaining tab protrudes from said second collar, said shield portion having a second aperture receiving said second retaining tab.

19. The two-piece female electrical terminal of claim 15, wherein said channel and said core crimp wings form a generally U-shaped region, said conductor contacting portion extending into said U-shaped region.

* * * * *